US008944560B2

(12) United States Patent
Aoki et al.

(10) Patent No.: US 8,944,560 B2
(45) Date of Patent: Feb. 3, 2015

(54) IMAGE FORMING APPARATUS

(71) Applicants: Sumiaki Aoki, Kanagawa (JP); Kohta Akiyama, Tokyo (JP)

(72) Inventors: Sumiaki Aoki, Kanagawa (JP); Kohta Akiyama, Tokyo (JP)

(73) Assignee: Ricoh Company, Limited, Gyeonggi-do (KR)

( * ) Notice: Subject to any disclaimer, the term of this patent is extended or adjusted under 35 U.S.C. 154(b) by 0 days.

(21) Appl. No.: 13/798,316

(22) Filed: Mar. 13, 2013

(65) Prior Publication Data

US 2013/0241986 A1 Sep. 19, 2013

(30) Foreign Application Priority Data

Mar. 17, 2012 (JP) ..... 2012-061283

(51) Int. Cl.

| | |
|---|---|
| ***B41J 2/165*** | (2006.01) |
| ***B41J 29/38*** | (2006.01) |
| ***B41J 2/045*** | (2006.01) |
| ***B41J 2/11*** | (2006.01) |
| *B41J 2/14* | (2006.01) |

(52) U.S. Cl.

CPC ..... *B41J 2/11* (2013.01); *B41J 2/04573* (2013.01); *B41J 2/04541* (2013.01); *B41J 2/04581* (2013.01); *B41J 2/04588* (2013.01); *B41J 2/04593* (2013.01); *B41J 2/04596* (2013.01); *B41J 2002/14403* (2013.01)

USPC ..... 347/27; 347/11; 347/70

(58) Field of Classification Search

CPC ..... B41J 2/04596

See application file for complete search history.

(56) References Cited

U.S. PATENT DOCUMENTS

| | | | | |
|---|---|---|---|---|
| 6,371,587 | B1 * | 4/2002 | Chang | 347/11 |
| 6,830,305 | B1 * | 12/2004 | Takizawa | 347/10 |
| 2003/0011653 | A1 | 1/2003 | Oikawa et al. | |
| 2003/0085962 | A1 * | 5/2003 | Junhua | 347/68 |
| 2005/0237350 | A1 | 10/2005 | Aoki | |
| 2010/0118075 | A1 * | 5/2010 | Miyazawa et al. | 347/10 |
| 2012/0229541 | A1 | 9/2012 | Satoh et al. | |

FOREIGN PATENT DOCUMENTS

| | | |
|---|---|---|
| JP | 2007-276287 | 10/2007 |
| JP | 4259741 | 2/2009 |

* cited by examiner

*Primary Examiner* — Shelby Fidler

(74) *Attorney, Agent, or Firm* — Harness, Dickey & Pierce

(57) ABSTRACT

An image forming apparatus includes: a recording head including multiple nozzles and multiple piezoelectric elements that generate pressure for causing droplets to be ejected from the nozzles; a driving-waveform generating unit that generates a driving waveform to be applied to the piezoelectric elements; first switching devices each disposed between the driving-waveform generating unit and respective one of the piezoelectric elements; second switching devices each disposed between a predetermined voltage and respective one of the piezoelectric elements; and a slight-vibration control unit. The slight-vibration control unit causes slight vibrations to be applied to a non-ejection nozzle by placing the second switch device for the non-ejection nozzle in a conduction state, and, when a predetermined period of time has elapsed after shift to the conduction state, placing the second switch device in a non-conduction state and the first switch device for the non-ejection nozzle in a conduction state.

8 Claims, 11 Drawing Sheets

IMAGE FORMING APPARATUS

CROSS-REFERENCE TO RELATED APPLICATIONS

The present application claims priority to and incorporates by reference the entire contents of Japanese Patent Application No. 2012-061283 filed in Japan on Mar. 17, 2012.

BACKGROUND OF THE INVENTION

1. Field of the Invention

The present invention generally relates to an image forming apparatus and, more particularly, to an image forming apparatus including a recording head that ejects droplets.

2. Description of the Related Art

Inkjet recording apparatuses are known as liquid-ejection-recording type image forming apparatuses, such as printers, facsimiles, copiers, plotters, and multifunction peripherals, that employ a liquid ejection head that ejects, for example, droplets as a recording head.

It is known that nozzle maintenance of a liquid ejection head of such an image forming apparatus can be performed by applying a slight-vibration generating waveform to a pressure generator of a nozzle (hereinafter, "non-ejection nozzle") from which a droplet is not to be ejected, thereby vibrating a meniscus of liquid in the nozzle in a manner that does not eject a droplet.

Known methods for applying such a slight-vibration generating waveform include a method of generating a common driving waveform containing an ejection waveform and the slight-vibration generating waveform and selecting one of the waveforms based on image data (ejection data). However, this method is disadvantageous in that because the driving waveform contains both the ejection waveform and the slight-vibration generating waveform, the driving waveform has a large waveform length and therefore is less preferable for speed-up.

A technique for solving this problem is disclosed in Japanese Patent Application Laid-open No. 2007-276287. In this technique, three voltage sources (a high voltage source, a medium voltage source, and a low voltage source) are connected to a piezoelectric element in a manner that allows applying a selected one of voltage outputs to the piezoelectric element or, in other words, applying a ternary digital driving waveform to the piezoelectric element. The three voltages are set such that a difference between the high voltage and the medium voltage differs from a difference between the medium voltage and the low voltage level. Slight vibrations, by which no droplet is ejected from a recording device, are generated by switching the connection so as to apply either a waveform ranging between the medium voltage and the high voltage or a waveform ranging between the medium voltage and the low voltage depending on an environmental temperature.

Japanese Patent No. 4259741 discloses an apparatus that includes a circuit for generating a first driving waveform that causes an ink droplet to be ejected in one drive period and a second driving waveform that vibrates an ink meniscus without causing an ink droplet to be ejected in time series, and a unit that selects the first driving waveform according to a print signal and selects, independently of the print signal, the second driving waveform according to a meniscus-vibration selecting signal generated every n (n is an integer greater than one) drive periods and applies the waveforms to a plurality of electrodes simultaneously.

However, the configuration disclosed in Japanese Patent Application Laid-open No. 2007-276287 that selectively applies one of the voltages of the plurality of voltage sources to the recording device has a problem that when adopted in an apparatus including a plurality of recording heads, if optimum slight-vibration generating waveforms vary due to variation among the recording heads, as many voltage sources as the recording heads become necessary. This leads to an increase in apparatus size.

The configuration disclosed in Japanese Patent No. 4259741 that allows selecting either the ejection waveform or the slight-vibration generating waveform separated from the common driving waveform has a problem that the apparatus needs to include two driving source systems specially for this driving scheme, which increases cost of the apparatus. Furthermore, the apparatus needs to include additional wiring for this driving scheme, which makes it difficult to miniaturize the apparatus.

In view of the problems mentioned above, there is needed to solve at least part of the problems and to configure an apparatus to be capable of generating slight vibrations without an increase in size of the apparatus.

SUMMARY OF THE INVENTION it is an object of the present invention to at least partially solve the problems in the conventional technology.

According to the present invention, there is provided an image forming apparatus comprising: a recording head including a plurality of nozzles for ejecting droplets of liquid, and a plurality of piezoelectric elements for generating pressure that causes the droplets to be ejected from the nozzles; a driving-waveform generating unit configured to generate a driving waveform to be applied to the piezoelectric elements of the recording head; first switching devices each disposed between the driving-waveform generating unit and respective one of the piezoelectric elements; second switching devices each disposed between a predetermined voltage and respective one of the piezoelectric elements; and a slight-vibration control unit configured to perform control for causing the piezoelectric element to generate slight vibrations that vibrate a meniscus of the liquid in the nozzle to an extent at which no droplet is ejected from the nozzle.

In the image forming apparatus mentioned above, when one or more nozzles of the nozzles is a non-ejection nozzle from which a droplet is not to be ejected, the slight-vibration control unit performs the control on each piezoelectric element for the one or more non-ejection nozzles of the piezoelectric elements by; changing a voltage state of the piezoelectric element by placing the second switch device for the piezoelectric element in a conduction state, and when a predetermined period of time has elapsed after shift to the conduction state of the second switch device; changing the voltage state of the piezoelectric element by placing the second switch device in a non-conduction state and placing the first switch device for the piezoelectric element in a conduction state.

The present invention also provides a method for controlling a recoding head that includes a plurality of nozzles for ejecting droplets of liquid, and a plurality of piezoelectric elements used for two vibration states by using a driving-waveform generating unit configured to generate a driving waveform to be applied to the piezoelectric elements, one vibration state generating pressure that causes the droplets to be ejected from the nozzles, another vibration state generating slight vibrations for at least one of the piezoelectric elements to vibrate a meniscus of the liquid of at least one of nozzles corresponding to the piezoelectric element to an extent at which no droplet is ejected from the nozzle.

In the method mentioned above, in the another vibration state, changing a voltage state of the piezoelectric element to a first voltage state by conducting a predetermined voltage to the piezoelectric element, and when a predetermined period of time has elapsed after shift to the first voltage state, changing the voltage state of the piezoelectric element to a second voltage state by switching off the conducting the predetermined voltage to the piezoelectric element, and connecting the driving-waveform generating unit to the piezoelectric element.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
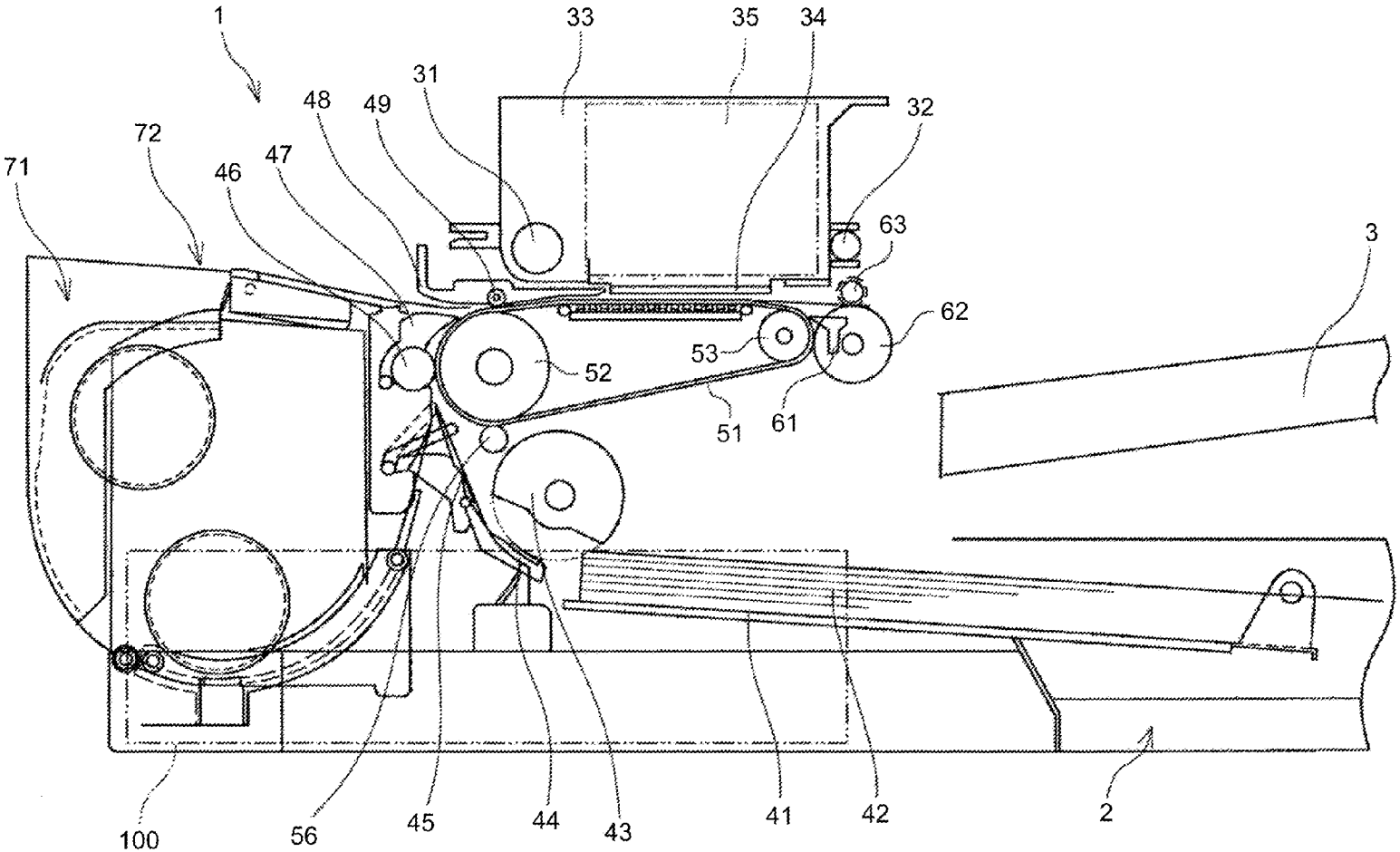
FIG. 1 is an explanatory side view illustrating a mechanism section of an image forming apparatus according to an implementation example of the present invention.
Figure 2:
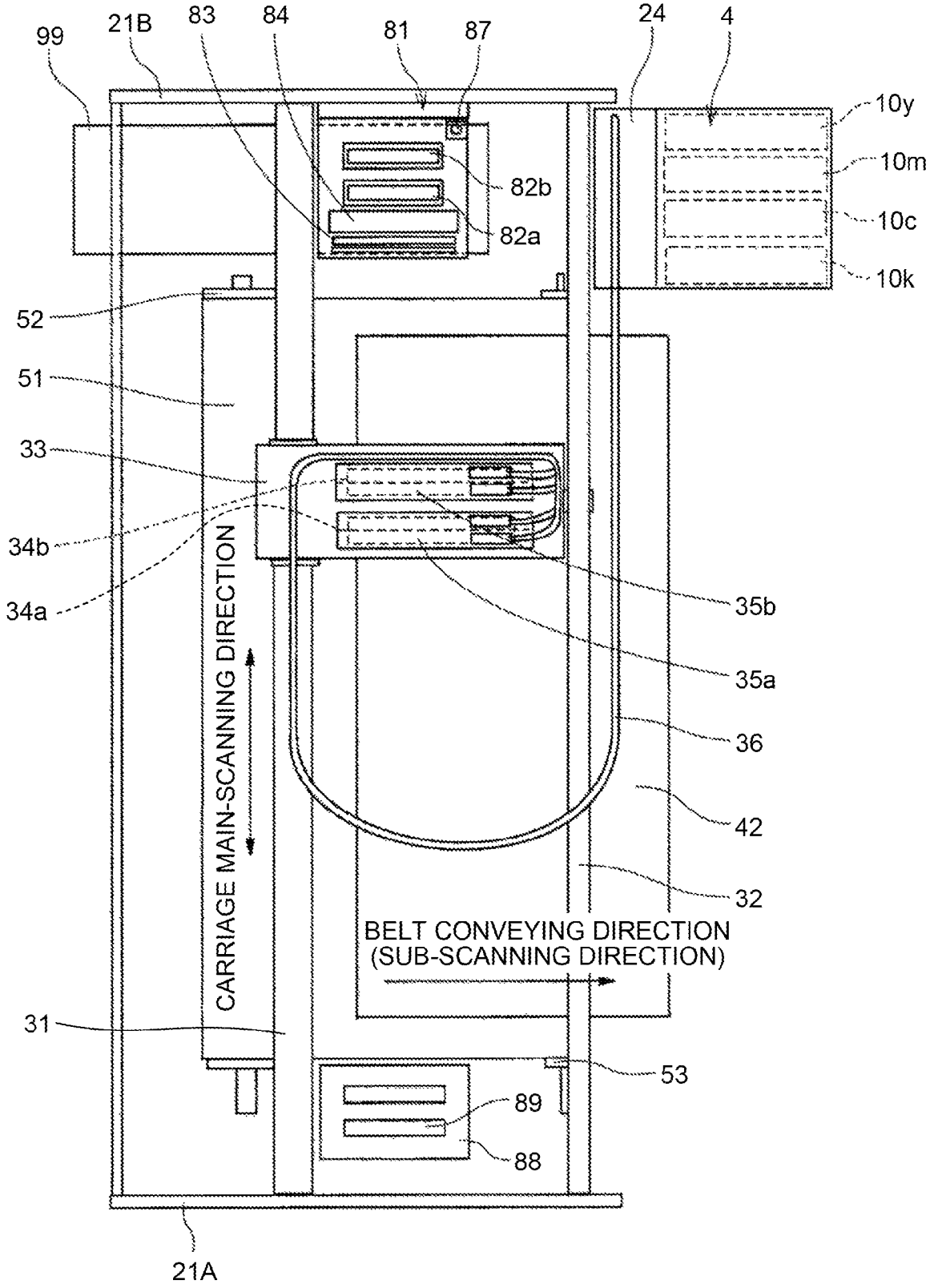
FIG. 2 is an explanatory plan view of a relevant portion of the mechanism section.

Preferred embodiments of the present invention are described below with reference to the accompanying drawings. An image forming apparatus according to an implementation example of the present invention is described first with reference to FIGS. 1 and 2. FIG. 1 is an explanatory side view illustrating an overall configuration of the image forming apparatus. FIG. 2 is an explanatory plan view of the apparatus.

The term "sheet" used herein is not limited to a sheet made of paper but can be any sheet-like member such as an overhead transparency film, fabric, glass, or a substrate onto which an ink droplet or other liquid can be deposited, and includes what is referred as a to-be-recorded medium, a recording medium, recording paper, a recording sheet, or the like. Image formation, recording, and printing are used as a synonym for one another.

The term "image forming apparatus" used herein denotes an apparatus that forms an image by ejecting liquid onto a medium such as paper, thread, fiber, textile, leather, metal, plastic, glass, wood, or ceramics. The term "image forming" used herein denotes not only forming an image of a character, a figure, or the like that carries some information on a medium but also forming an image such as a pattern that carries no information on a medium (in other words, simply causing droplets to impact on the medium).

The term "ink" used herein is not limited to what is generally referred to as ink unless otherwise specified, but used as a generic name for all liquids, with which an image can be formed, such as recording liquid and fixation processing liquid. The "ink" can be a DNA sample, a resist material, a patterning material, a plastic, or the like.

The term "image" used herein is not limited to a two-dimensional image but can be an image formed on a three-dimensional (3D) object or a 3D object formed by 3D printing.

The term "slight-vibration" used herein means a vibration that causes a piezoelectric element to vibrate a meniscus of or a surface of the liquid in the nozzle to an extent at which no droplet is ejected from the nozzle Unless otherwise specified, the image forming apparatus may be either a serial-head image forming apparatus or a line-head image forming apparatus.

The image forming apparatus according to the implementation example is a serial-head inkjet recording apparatus and includes side plates 21A and 21B on left and right sides of an apparatus body 1, and a driving guide rod 31 and a driven guide rod 32 which are guide members laid laterally across, and supported by, the side plates 21A and 21B. The guide rods 31 and 32 support a carriage 33 in a manner that allows the carriage 33 to slide in the main-scanning direction. The carriage 33 is moved via a timing belt by a main-scanning motor (not shown) in a direction indicated by arrow in FIG. 2 (the carriage main-scanning direction).

The carriage 33 includes recording heads 34*a* and 34*b* (hereinafter, referred to as the "recording heads 34" when discrimination between 34*a* and 34*b* is not made) which are liquid ejection heads for ejecting droplets of different colors (yellow (Y), cyan (C), magenta (M), and black (K)) from a plurality of nozzles arranged in a sub-scanning direction perpendicular to the main-scanning direction. The recording heads 34 are mounted so as to eject the ink droplets downward.

Each of the recording heads 34 includes two nozzle arrays. The recording head 34*a* includes a first nozzle array for ejecting black (K) ink droplets and a second nozzle array for ejecting cyan (C) ink droplets, whereas the recording head 34*b* includes a first nozzle array for ejecting magenta ink droplets and a second nozzle array for ejecting yellow (Y) ink droplets. Alternatively, the recording head 34 may include a nozzle face on which a plurality of nozzle arrays of the respective colors are arranged.

The carriage 33 carries thereon head reservoirs 35*a* and 35*b* (hereinafter, simply referred to as the "head reservoirs 35" when discrimination between 35*a* and 35*b* is not made) serving as a second ink supplying unit for supplying inks of the respective colors to the nozzle arrays of the recording heads 34. The recording liquids of the respective colors are supplied from ink cartridges (main reservoirs) 10*y*, 10*m*, 10*c*, and 10*k* to the head reservoirs 35 by a supply pump unit 24 via supply tubes 36 for the respective colors. The ink cartridges 10*y*, 10*m*, 10*c*, and 10*k* are detachably mounted on a cartridge holder 4.

The image forming apparatus also includes a sheet feeding unit for feeding sheets 42 placed on a sheet loading section (pressing plate) 41 of a sheet cassette 2. The sheet feeding unit includes a half-moon-shaped roller (feed roller) 43 that picks up and feeds the sheets 42 on the sheet loading section 41 one sheet by one sheet and a separating pad 44 disposed to face the feed roller 43 and made from a material having a high coefficient of friction. The separating pad 44 is biased toward the feed roller 43.

The image forming apparatus further includes a guide 45 that guides the sheet 42, a counter roller 46, a conveyance guide member 47, and a retaining member 48 that includes a leading-end pressing roller 49 to transfer the sheet 42 fed from the sheet feeding unit to below the recording heads 34. The image forming apparatus also includes a conveying belt 51 that electrostatically attracts the fed sheet 42 and conveys the sheet 42 through an area where the sheet 42 faces the recording heads 34.

The conveying belt 51 which is an endless belt is looped over a conveying roller 52 and a tension roller 53 so as to circle in a belt conveying direction (the sub-scanning direction). The image forming apparatus further includes an electrostatic charging roller 56 which is an electrostatic charger that electrostatically charges a surface of the conveying belt 51. The electrostatic charging roller 56 is arranged so as to come into contact with a surface layer of the conveying belt 51 to be rotated by circling movement of the conveying belt 51. The conveying belt 51 is driven via timing belt by rotation of the conveying roller 52 that is rotated by a sub-scanning motor (not shown) to circle in the belt conveying direction illustrated in FIG. 2.

The image forming apparatus further includes a sheet discharging unit for discharging the sheet 42 undergone recording performed by the recording heads 34. The sheet discharging unit includes a separating lug 61 for separating the sheet 42 from the conveying belt 51, a sheet discharging roller 62, a spur (which is a sheet discharging roller) 63, and a sheet output tray 3. The sheet output tray 3 is at a position lower than the sheet discharging roller 62.

The image forming apparatus also includes a duplex printing unit 71 detachably mounted on a back portion of the apparatus body 1. The duplex printing unit 71 takes in the sheet 42 that is moved backward by reverse rotation of the conveying belt 51, turns upside down the sheet 42, and then delivers the sheet 42 to a nip between the counter roller 46 and the conveying belt 51. A top surface of the duplex printing unit 71 is configured as a bypass tray 72.

The image forming apparatus further includes a maintenance/recovery mechanism 81 for maintaining and recovering a state of the nozzles of the recording heads 34. The maintenance/recovery mechanism 81 is in a non-printing area near one end in the scanning direction of the carriage 33. The maintenance/recovery mechanism 81 includes cap members 82*a* and 82*b* (hereinafter, simply referred to as the "caps 82" when discrimination between 82*a* and 82*b* is not made) for capping the nozzle faces of the recording heads 34, a wiper member (wiper blade) 83 for wiping the nozzle faces, an idle ejection receptacle 84 for receiving droplets ejected as idle ejection, and a carriage lock 87 for locking the carriage 33. The idle ejection is performed to discharge thickened recording liquid by ejecting droplets that are not used in image forming. The image forming apparatus further includes a waste liquid reservoir 99 that is detachably mounted on the apparatus body at a portion below the maintenance/recovery mechanism 81 to store therein waste liquid produced by maintenance/recovery operations.

The image forming apparatus further includes an idle ejection receptacle 88 in a non-printing area near the other end in the scanning direction of the carriage 33 for receiving droplets ejected as idle ejection. The idle ejection is performed to discharge thickened recording liquid by ejecting droplets that are not used in image forming. The idle ejection receptacle 88 has openings 89 arranged in a direction of the nozzle array of the recording heads 34 and the like.

In the image forming apparatus configured as described above, the sheets 42 are picked up from the sheet cassette 2 and fed one sheet by one sheet. The sheet 42 fed substantially upward is guided by the guide 45 and conveyed by being pinched between the conveying belt 51 and the counter roller 46. The sheet 42 is further guided at its leading end by a conveyance guide member 47 and pressed by the leading-end pressing roller 49 against the conveying belt 51, so that the conveying direction is turned approximately 90 degrees.

In this process, positive and negative voltages are alternately applied to the electrostatic charging roller 56, thereby electrostatically charging the conveying belt 51 so as to form an alternating positive and negative charge pattern. When the sheet 42 is fed onto the charged conveying belt 51, the sheet 42 is attracted onto the conveying belt 51 and conveyed in the sub-scanning direction by the circling movement of the conveying belt 51.

One line is recorded on the sheet 42 by, while the carriage 33 is moved, driving the recording heads 34 carried on the carriage 33 to eject ink droplets onto the stationary sheet 42 according to image signals. The sheet 42 is then conveyed a predetermined distance, and thereafter a next line is recorded on the sheet 42. When a record-end signal or a signal indicating that a trailing end of the sheet 42 has reached the recording area, the recording operation is stopped and the sheet 42 is output onto the sheet output tray 3.

When maintenance/recovery of the nozzles of the recording heads 34 is performed, the carriage 33 is moved to a home position where the carriage 33 faces the maintenance/recovery mechanism 81. The maintenance/recovery mechanism 81 performs a maintenance/recovery operation such as nozzle purge of capping the nozzles with the caps 82 and sucking liquid from the nozzles or idle ejection of ejecting droplets that are not used in image formation so that an image can be formed with stable droplet ejection.

Figure 3:
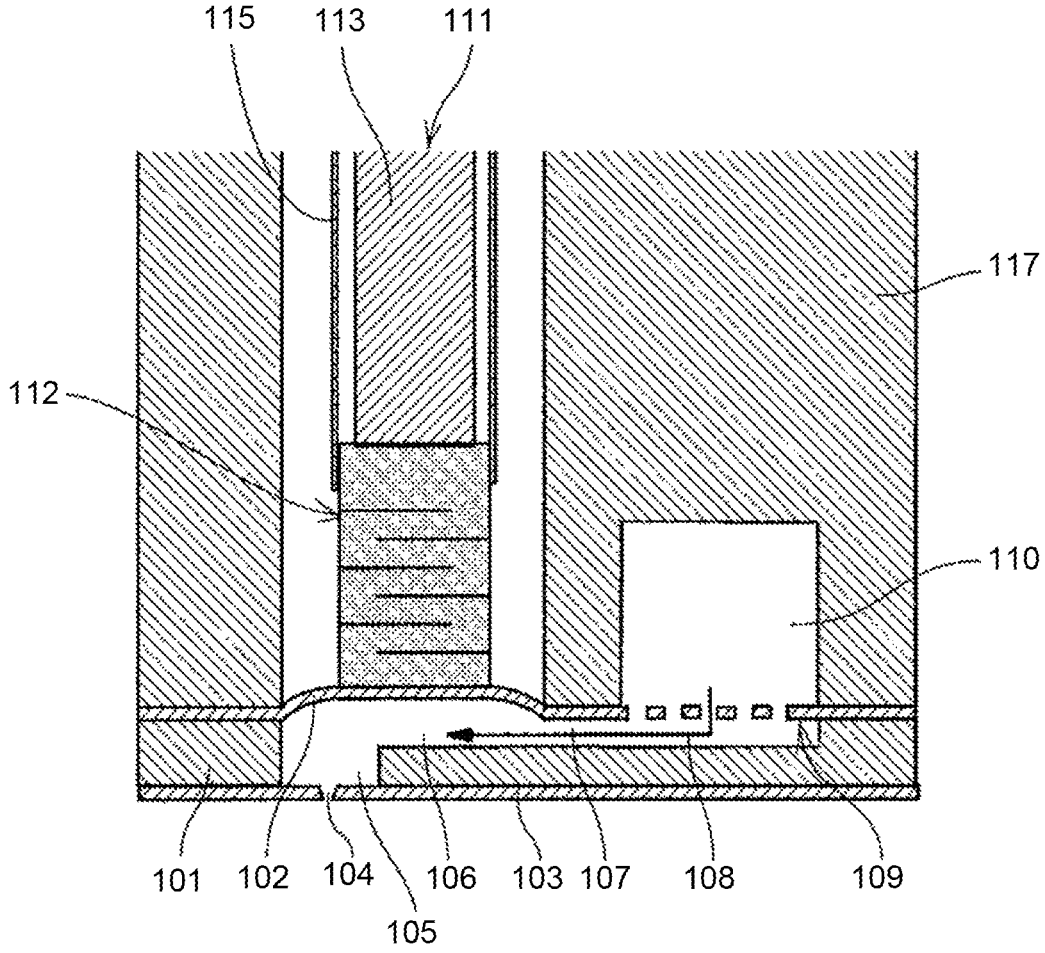
FIG. 3 is an explanatory cross-sectional view, taken along a longitudinal direction of liquid chambers, illustrating an example of a liquid ejection head of a recording head of the image forming apparatus.
Figure 4:
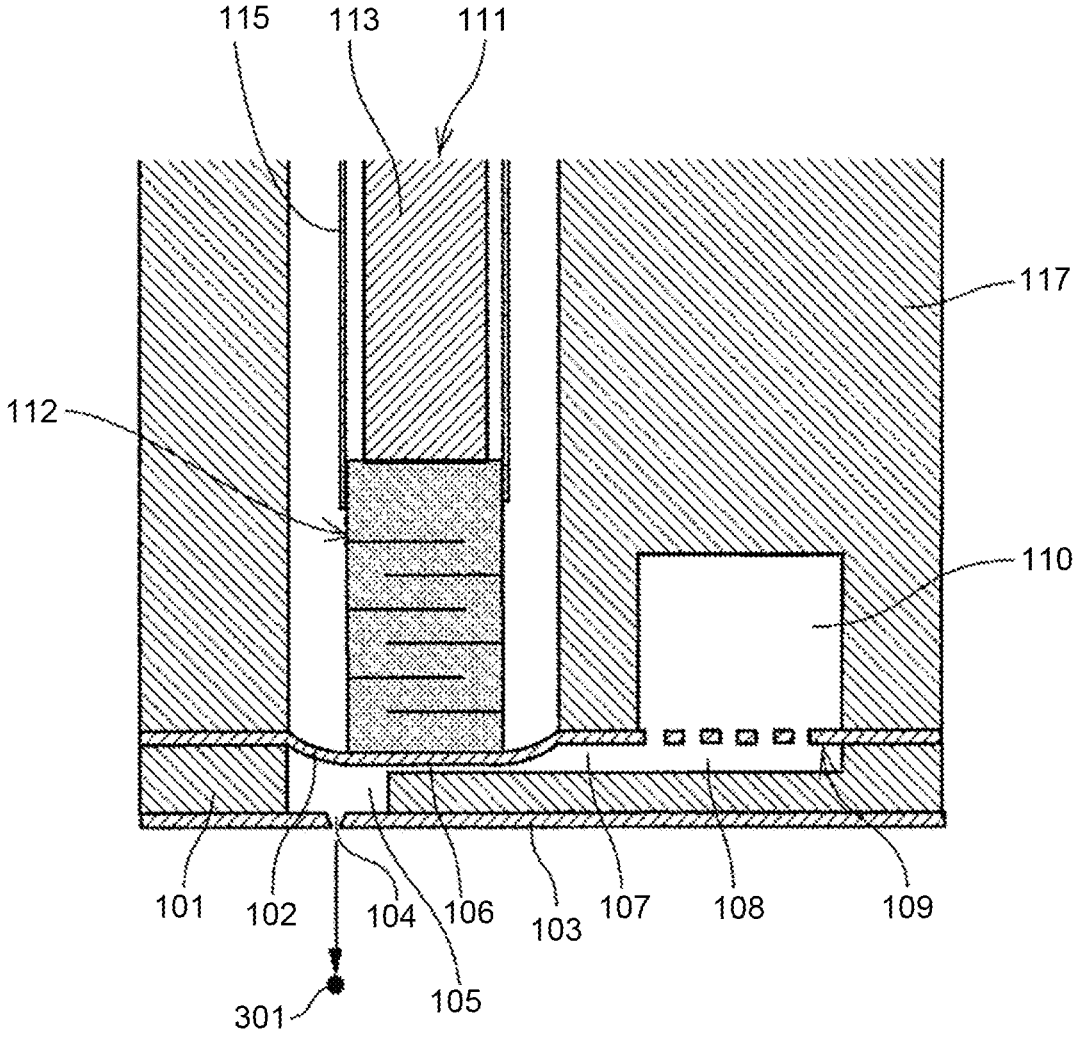
FIG. 4 is an explanatory cross-sectional view for describing droplet ejection of the liquid ejection head.
Figure 5:
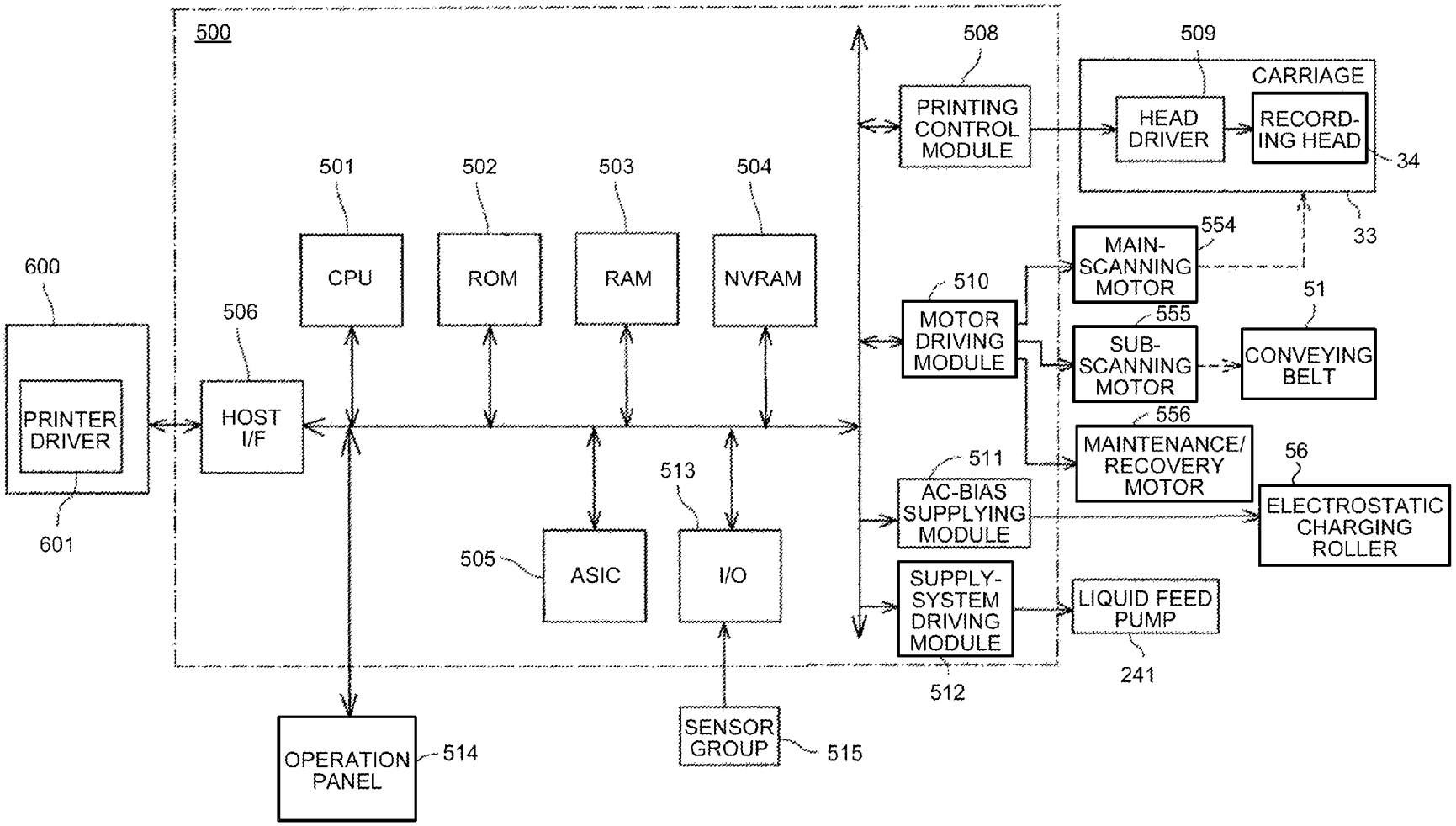
FIG. 5 is an explanatory block diagram illustrating an overview of a control unit of the image forming apparatus.

An example of the liquid ejection head as the recording head 34 is described below with reference to FIGS. 3 and 4. FIGS. 3 and 4 are explanatory cross-sectional views of the liquid ejection head taken along a longitudinal direction (direction perpendicular to the direction the nozzle array) of liquid chambers of the liquid ejection head.

The liquid ejection head includes a channel plate 101, a diaphragm 102, a nozzle plate 103, nozzles 104, through holes 105, liquid chambers 106, a fluid resistance portion 107, and a liquid inlet portion 108. The channel plate 101, the diaphragm 102, and the nozzle plate 103 are joined to define the liquid chambers 106 which are, specifically, a pressurized chamber, a pressurized liquid chamber, a pressure chamber, individual channels, a pressure generating chamber, and the like (hereinafter, simply referred to as the "liquid chambers"). The nozzles 104 that eject droplets are in communication with the liquid chambers 106 via the through holes 105. The fluid resistance portion 107 supplies liquid to the liquid chambers 106. Liquid (ink) is introduced from a common liquid chamber 110 defined in a frame member 117 into the liquid inlet portion 108 via a filter 109. The ink is supplied from the liquid inlet portion 108 to the liquid chambers 106 via the fluid resistance portion 107.

Openings and grooves such as the through holes 105, the liquid chambers 106, the fluid resistance portion 107, and the liquid inlet portion 108 are provided in the channel plate 101 which is formed by laminating metal plates of stainless steel or the like. The diaphragm 102 serves as a wall member of the liquid chambers 106, the fluid resistance portion 107, the liquid inlet portion 108, and the like and is a member in which the filter 109 is formed. Note that the channel plate 101 is not limited to a metal plate of stainless steel or the like but can be formed by anisotropic etching onto a silicone substrate.

A stacked piezoelectric element device 112 which is a columnar electromechanical transducer serving as a driving device (an actuator, a pressure generator) that generates energy for pressing ink in the liquid chambers 106 to eject droplets of the ink from the nozzles 104 is joined to the diaphragm 102 on a side opposite to the liquid chambers 106. The piezoelectric element device 112 is connected at one end to a base member 113. A flexible printed circuit (FPC) 115 for transferring driving waveforms to the piezoelectric element device 112 is connected to the piezoelectric element device 112. A piezoelectric actuator 111 is made up of these members.

In this implementation example, the piezoelectric element device 112 in d33 mode in which the piezoelectric element device 112 expands and contracts in a stacked direction is used. Alternatively, the piezoelectric element device 112 may be in d31 mode in which the piezoelectric element device 112 expands and contracts in a direction perpendicular to the stacked direction.

In the liquid ejection head configured as described above, the piezoelectric element device 112 contracts as illustrated in FIG. 3 when a voltage applied to the piezoelectric element device 112 drops from a reference voltage Ve, for instance. As a result, the diaphragm 102 is deformed to increase volumetric capacity of the liquid chambers 106, causing ink to flow into the liquid chambers 106. Thereafter, as illustrated in FIG. 4, the voltage applied to the piezoelectric element device 112 is raised to expand the piezoelectric element device 112 in the stacked direction so that the diaphragm 102 is deformed toward the nozzles 104 and the volumetric capacity of the liquid chambers 106 decreases. As a result, the ink in the liquid chambers 106 is pressurized, and droplets 301 are ejected from the nozzles 104.

When the voltage applied to the piezoelectric element device 112 is lowered back to the reference voltage Ve, the diaphragm 102 returns to its initial position. As a result, the liquid chambers 106 expand, causing a negative pressure to develop. At this time, ink is supplied from the common liquid chamber 110 to refill the liquid chambers 106. After vibrations of a meniscus of the ink in the nozzles 104 are damped and become stable, control proceeds to an operation for next droplet ejection.

Figure 6:
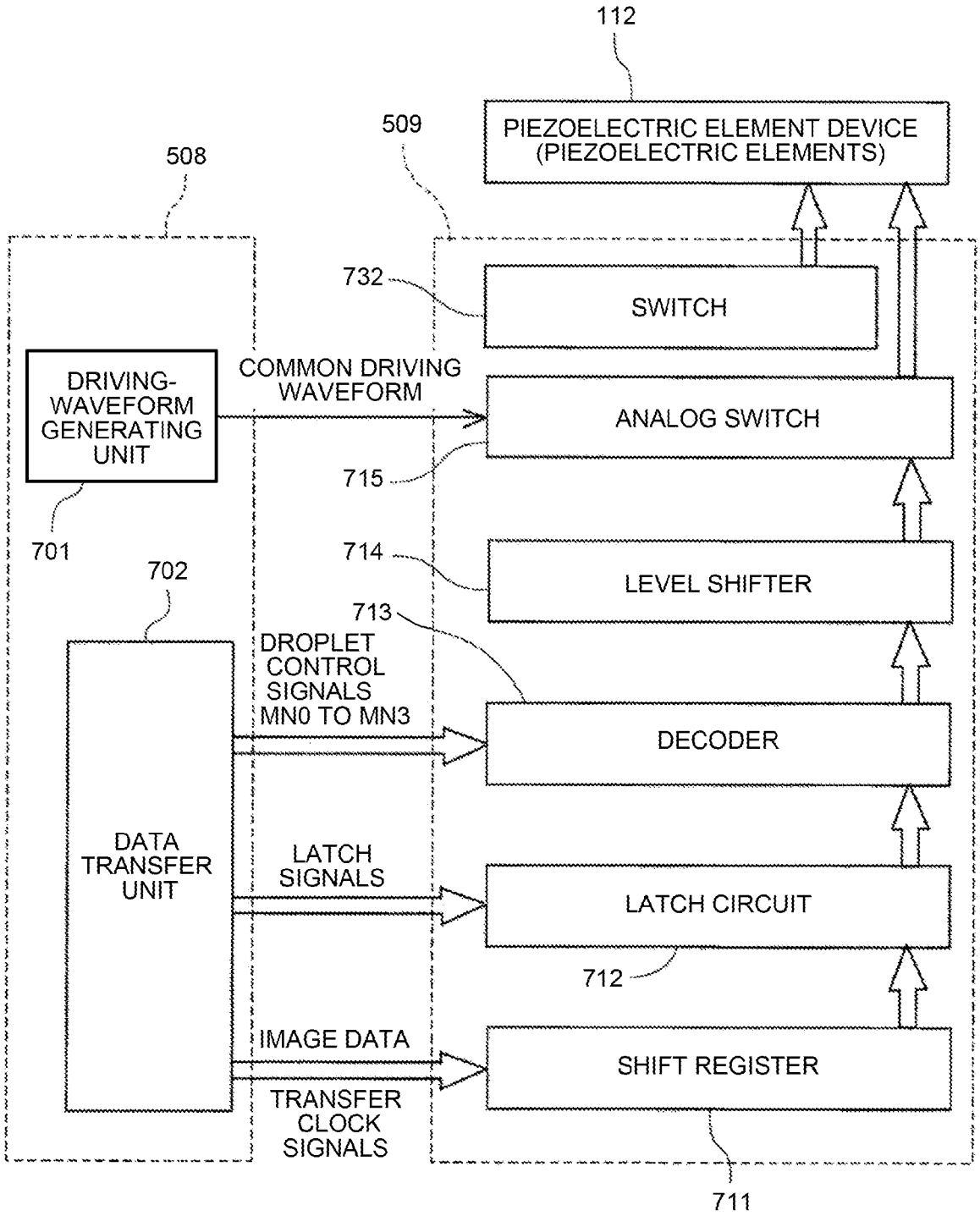
FIG. 6 is an explanatory block diagram illustrating a printing control module and an example of a head driver of the control unit.

An overview of a control unit 500 of the image forming apparatus is described below with reference to FIG. 6. FIG. 6 is an explanatory block diagram of the control unit 500.

A control unit 500 includes a central processing unit (CPU) 501 for controlling the entire apparatus, a read only memory (ROM) 502 for storing fixed data including program instructions such as those for execution by the CPU 501, a random access memory (RAM) 503 for temporarily storing image data and the like, a rewritable, a nonvolatile RAM (NVRAM) 504 for holding data even while power source of the apparatus is shut down, and an application specific integrated circuit (ASIC) 505. The ASIC 505 processes input/output signals for various signal processing performed on image data, image processing including sorting, and for overall control of the apparatus.

The control unit 500 further includes a printing control module 508, a head driver (driver IC) 509, a motor driving module 510, an AC-bias supplying module 511, and a supply-system driving module 512. The printing control module 508 includes a data transfer unit 702 and a driving-waveform generating unit 701 for driving and controlling the recording heads 34. The head driver 509 for use in driving the recording heads 34 is disposed on the carriage 33. The motor driving module 510 drives a main-scanning motor 554 that moves the carriage 33 to perform scanning, a sub-scanning motor 555 that moves the conveying belt 51 so as to circle, a maintenance/recovery motor 556 that moves the caps 82 and the wiper member 83 of the maintenance/recovery mechanism 81, and performs nozzle suctioning. The AC-bias supplying module 511 supplies an AC bias to the electrostatic charging roller 56. The supply-system driving module 512 drives a liquid feed pump 241.

The control unit 500 is connected to an operation panel 514 for use in inputting and displaying information necessary for the apparatus.

The control unit 500 includes a host interface (I/F) 506 for use in data and signal communications with a host apparatus. The control unit 500 receives data through the I/F 506 transmitted over a cable or a network from a host apparatus 600. The host apparatus 600 can be a data processing apparatus such as personal computer, an image reading apparatus such as an image scanner, an imaging apparatus such as a digital camera, or the like.

The CPU 501 of the control unit 500 reads out print data from a receive buffer of the host 1/F 506, analyzes the print data, performs necessary processing such as image processing and data sorting to obtain image data using the ASIC 505, and transfers the image data from the printing control module 508 to the head driver 509. Meanwhile, dot pattern data based on which an image is to be output can be generated by either a printer driver 601 of the host apparatus 600 or the control unit 500.

The printing control module 508 performs serial transfer of the thus-obtained image data and also outputs transfer clock signals, latch signals, control signals, and the like necessary for this transfer and committing the transfer to the head driver 509. Furthermore, the printing control module 508 outputs to the head driver 509 a driving signal containing one or more driving waveforms generated by the driving-waveform generating unit 701 included in the printing control module 508. The driving-waveform generating unit 701 includes a D/A converter that performs D/A conversion of driving-waveform pattern data stored in the ROM 502, a voltage amplifier, and a current amplifier.

The head driver 509 drives the recording head 34 by selecting a driving waveform and applying the selected driving waveform to the piezoelectric element device 112 serving as the pressure generator that generates energy for causing the recording head 34 to eject droplets. The driving waveform is selected from a driving waveform fed from the printing control module 508 based on serially-input image data that corresponds to one line for the recording head 34. At this time, it is possible to eject a droplet of a desired one of different sizes, e.g., a large size, a medium size, and a small size, by selecting all or a part of waveforms that form the driving waveform, or all or a part of waveform components that form a waveform.

An input-output (I/O) unit 513 acquires data from a sensor group 515 made up of various sensors mounted on the apparatus, extracts information necessary for printer control from the data, and uses the information in controlling the printing control module 508, the motor driving module 510, and the AC-bias supplying module 511. The sensor group 515 includes optical sensors for detecting sheet positions, a thermistor for monitoring a temperature in the apparatus, a sensor for monitoring the voltage of the electrostatic charging belt 51, and an interlock switch for detecting an open/close state of a cover. The I/O unit 513 is capable of processing various sensor data.

The printing control module 508 and an example of the head driver 509 are described below with reference to FIG. 6.

The printing control module 508 includes a driving-waveform generating unit 701 and a data transfer unit 702. The driving-waveform generating unit 701 generates a driving waveform (common driving waveform) that contains a plurality of driving waveforms (driving signals) in one printing period (one drive period) and outputs the driving waveform for image formation. The driving-waveform generating unit 701 also generates an idle-ejection driving waveform that contains a plurality of idle-ejection driving waveforms (driving signals) in one idle-ejection drive period and outputs the idle-ejection driving waveform for the idle-ejection driving. The data transfer unit 702 outputs 2-bit image data (gray-scale signals of 0s and 1s) representing a to-be-printed image, clock signals, latch signals (LAT), and droplet control signals M0 to M3.

Meanwhile, the droplet control signal is a 2-bit signal that instructs an analog switch 715, which is a switching unit to be described later of the head driver 509, to switch on and off on a per-droplet basis. The droplet control signal transits to a high (H) (ON) state for a pulse or a waveform component to be selected in accordance with the printing period of the common driving waveform, while transits to a low (L) (OFF) state when not selected.

The head driver 509 includes a shift register 711, a latch circuit 712, a decoder 713, a level shifter 714, the analog switch 715, and a switch 732, which will be described later. The shift register 711 receives inputs of transfer clock signals (shift clock signals) and serial image data (gray scale data: 2 bits per channel (per nozzle)) transferred from the data transfer unit 702. The latch circuit 712 latches register values pertaining to the shift register 711 according to the latch signals. The decoder 713 decodes the gray scale data and the droplet control signals M0 to M3 and outputs a result of the decoding. The level shifter 714 converts logic-level voltage signals output from the decoder 713 to a level range at which the analog switch 715 is operable. The analog switch 715 is switched on and off (open and close) according to the output of the decoder 713 fed to the analog switch 715 via the level shifter 714.

The analog switch 715 is connected to each of the selection electrodes (individual electrodes) of the piezoelectric element device 112 and receives an input of a common driving waveform Vcom from the driving-waveform generating unit 701. Accordingly, by switching on the analog switch 715 according to the decoding result, output from the decoder 713, of the serially transferred image data (gray scale data) and the droplet control signals M0 to M3, an appropriate pulse (or waveform component) can be extracted (selected) from the common driving waveform and applied to the piezoelectric element device 112.

Figure 7:
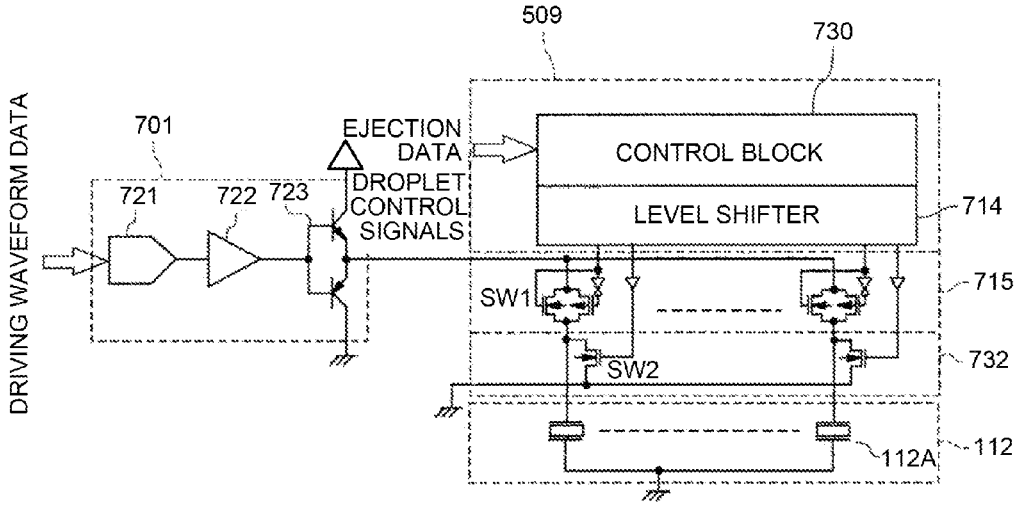
FIG. 7 is an explanatory block diagram of portions relevant to head driving according to a first embodiment of the present invention.

A first embodiment of the present invention is described below with reference to FIG. 7. FIG. 7 is an explanatory diagram of portions relevant to head driving according to the first embodiment.

The driving-waveform generating unit 701 converts driving waveform data read out from the ROM 502 into analog signals using a digital-to-analog converter (DAC) 721, amplifies the analog signals using an amplifier circuit 722, and current-amplifies the signals using a current amplifier circuit 723, thereby generating the common driving waveform Vcom.

As described above, the head driver (driver IC) 509 includes a control block 730, the level shifter 714, the analog switch 715 which is a first switching device, and the switch 732 which is a second switching device. The control block 730 includes the shift register 711 for receiving ejection data and the droplet control signals, the latch circuit 712, and the decoder 713. The level shifter 714 converts an output of the decoder 713 of the control block 730 to signals in a level range at which the two switch devices can be switched on and off.

The analog switch 715 is embodied as, for instance, a positive-channel metal oxide semiconductor (pMOS) or a negative-channel MOS (nMOS) transistor. The analog switch 715 is connected at one terminal to the driving-waveform generating unit 701 and at the other terminal to a piezoelectric element 112A (hereinafter, the analog switch 715 for one piezoelectric element 112A is referred to as the "switch SW1"). The switch 732 is embodied as, for instance, an nMOS switch. The switch 732 is connected at one terminal to the ground and at the other terminal to the piezoelectric element 112A (hereinafter, the analog switch 715 for one piezoelectric element is referred to as the "switch SW2").

Figure 8:
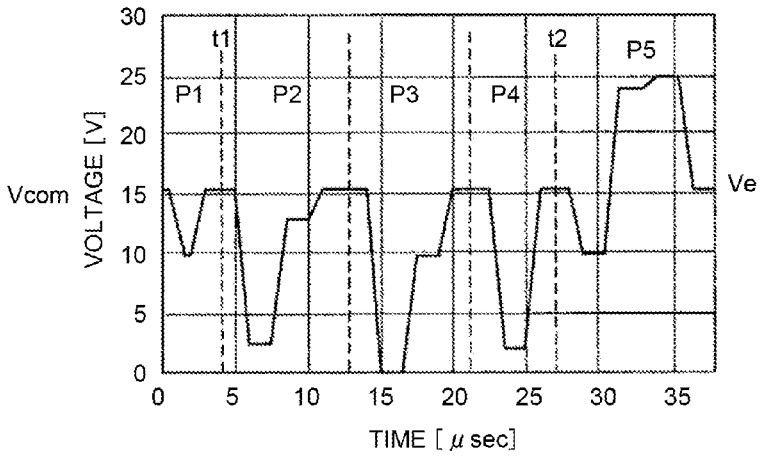
FIG. 8 is an explanatory diagram of a common driving waveform according to the first embodiment.

The common driving waveform and driving waveforms for the respective droplet sizes are described below with reference to FIGS. 8 to 9C. FIG. 8 is an explanatory diagram of the common driving waveform. FIGS. 9A to 9C are explanatory diagrams of the driving waveforms for the respective droplet sizes each generated from the common driving waveform.

As illustrated in FIG. 8, the common driving waveform Vcom is a waveform that contains five time-series driving waveforms, which are a first waveform P1, a second waveform P2, a third waveform P3, a fourth waveform P4, and a fifth waveform P5, having an intermediate voltage Vm as a reference voltage.

In the first embodiment, one printing period (one drive period) is set to 1/40 kHz, and the period of the common driving waveform Vcom is set to 37 μsec which is shorter than 1/40 kHz in consideration of external variations in the drive period. The intermediate voltage Vm of the common driving waveform Vcom is set to 15 V.

Figure 9A:
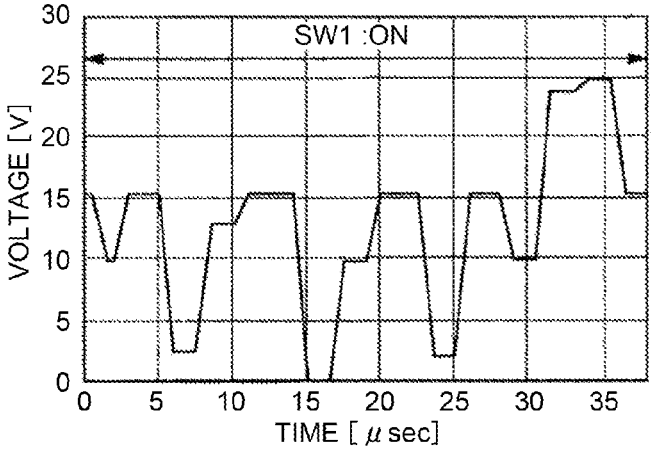
FIGS. 9A to 9C are explanatory diagrams of driving waveforms for respective droplet sizes each extracted from the common driving waveform according to the first embodiment.
Figure 9B:
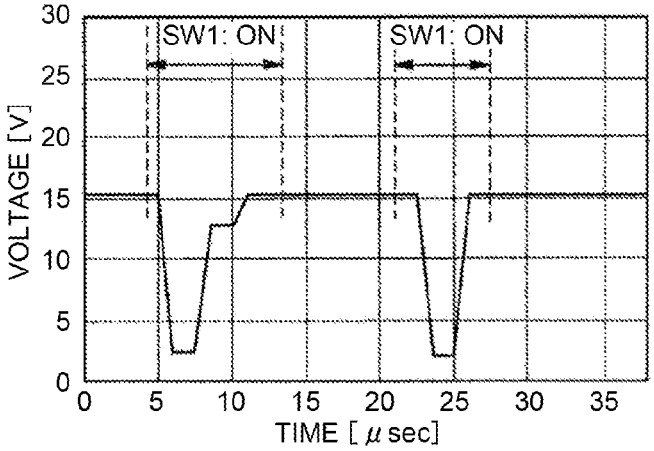
Figure 9C:
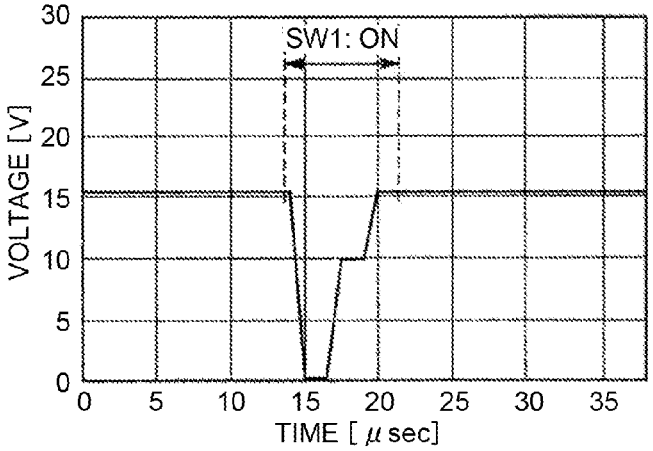

By extracting (selecting) appropriate one or more driving waveforms from the common driving waveform Vcom according to the droplet control signals MN0 to MN3, one of a driving waveform for a large-size droplet such as that illustrated in FIG. 9A, a driving waveform for a medium-size droplet such as that illustrated in FIG. 9B, and a driving waveform for a small-size droplet such as that illustrated in FIG. 9C is generated. Accordingly, a driving waveform for appropriate one of the droplet sizes can be applied to the corresponding piezoelectric element 112A by switching on the switch SW1 according to ejection data (image data).

Generation of a slight vibration according to the first embodiment is described below with reference to FIG. 10.

Figure 10:
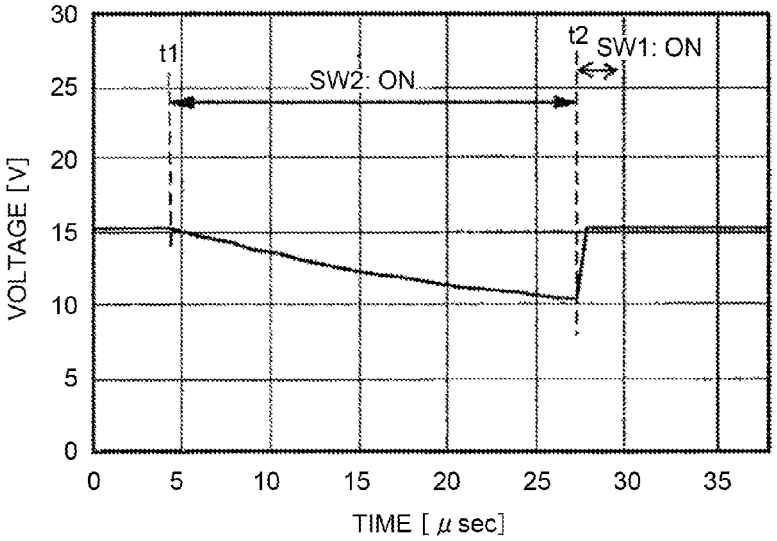
FIG. 10 is an explanatory diagram illustrating an example of changes in voltage of a piezoelectric element generating a slight vibration according to the first embodiment.

FIG. 10 is an explanatory diagram illustrating an example of changes in voltage of a piezoelectric element generating the slight vibration.

Slight vibrations, by which a meniscus of liquid in the nozzle is vibrated to an extent at which a droplet is not ejected from the nozzle, are applied to a non-ejection nozzle which is a nozzle from which a droplet is not to be ejected.

Each of the piezoelectric elements 112A of the recording head of the first embodiment is assumed to generate an effective slight vibration when a sudden change in voltage of 5 to 7 V is applied to the piezoelectric element 112A. Accordingly, a necessary voltage Vb for generating the slight vibration is (Vm+5) V or higher or (Vm−5) V or lower with reference to the intermediate voltage (reference voltage) Vm of the common driving waveform Vcom. In the first embodiment, the single piezoelectric element 112A is assumed to have a capacitance of 1,000 pF.

A resistance of the switch SW2 in the ON (conduction) state is set to a value that, when the piezoelectric element 112A charged to the intermediate voltage Vm is discharged over a period shorter than a period (ejection period) T corresponding to the drive period with the switch SW2 in the ON state, causes the piezoelectric element 112A to have a voltage equal to or lower than (Vm−5) V. A resistance of the switch SW1 in the ON (conduction) state is set to a value that does not degrade a selected (to-be-input) portion of the common driving waveform Vcom. In the first embodiment, the resistance is set to 50 kΩ.

Referring to FIG. 10, when the slight vibration is to be applied to a nozzle, the switch SW2 of the piezoelectric element 112A for the nozzle is placed in the conduction state (ON state) at t1 which is a time point immediately after the first waveform P1 of the common driving waveform Vcom is generated and output or, in the example illustrated in FIG. 10, at a time point of 4 μsec. This ON state of the switch SW2 is maintained until a time point t2 which is at an end of the fourth waveform P4. Specifically, in the example illustrated in FIG. 10, the ON state of the switch SW2 is maintained from a time point at which the common driving waveform Vcom starts until a time point of 27 μsec.

When the switch SW2 is in the ON state, the switch SW2 and the piezoelectric element 112A form a closed circuit. Accordingly, charges accumulated in the piezoelectric element 112A self-discharges through the switch SW2, and the voltage of the piezoelectric element 112A decreases with a time constant that defined by the ON resistance of the switch SW2 and the capacitance of the piezoelectric element 112A. In the example illustrated in FIG. 10, the voltage of the piezoelectric element 112A decreases to 9.5 V.

The switch SW2 and the switch SW1 are switched to the non-conduction state (OFF state) and the ON state, respectively, at the end of the waveform of the fourth waveform P4.

At this time, the driving-waveform generating unit 701, the switch SW1, and the piezoelectric element 112A form a closed circuit. Because the output impedance of the driving-waveform generating unit 701 is low, the voltage of the piezoelectric element 112A changes with the time constant that defined by the ON resistance of the switch SW1 and the capacitance of the piezoelectric element 112A.

Meanwhile, because the ON resistance of the switch SW1 is considerably lower than the ON resistance of the switch SW2, the voltage of the piezoelectric element 112A rises sharply from the time point t2 to the intermediate voltage Vm.

This sharp rise causes the piezoelectric element 112A to expand and a meniscus of ink to move. Thus, the slight vibration is generated.

As described above, speed-up can be achieved by more simple configuration, because the slight vibration can be performed without using a driving-waveform generating device provided only for generating the slight vibration, and without elongating period of the driving-waveform.

Because the ON resistance of the switch SW2 is higher than the ON resistance of the switch SW1, an increase in size of the driver IC is small as compared with a configuration that includes two analog switches only for generating the slight vibration.

Figure 11:
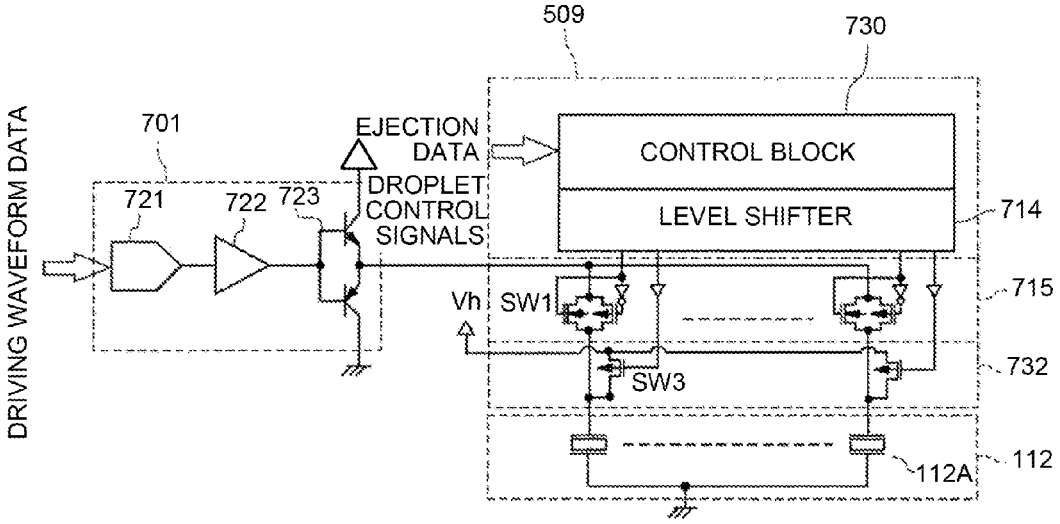
FIG. 11 is an explanatory block diagram of portions relevant to head driving according to a second embodiment of the present invention.

A second embodiment of the present invention is described below with reference to FIG. 11. FIG. 11 is an explanatory diagram of portions relevant to head driving according to the second embodiment.

In the second embodiment, the switch 732, which is the second switch device, is a pMOS switch that is connected at one terminal to the power source of a high voltage Vh of the head driver 509 and at the other terminal to the piezoelectric element 112A (hereinafter, the switch 732 for the one piezoelectric elements 112A is referred to as the "switch SW3"). Put another way, the second switch device is connected at the one terminal to a voltage Vh higher than the intermediate voltage Vm that is the reference of the common driving waveform Vcom. In the second embodiment, the high voltage Vh is set to 40 V, and an average ON resistance of the switch SW3 is set to 100 kΩ.

A resistance of the switch SW3 in the ON (conduction) state is set to a value that, when the piezoelectric element 112A charged to the intermediate voltage Vm is charged over a period shorter than the period T corresponding to the drive period with the switch SW3 in the ON state, causes the piezoelectric element 112A to have a voltage equal to or higher than (Vm+Vb (in this example, Vb=5)) V.

Figure 12:
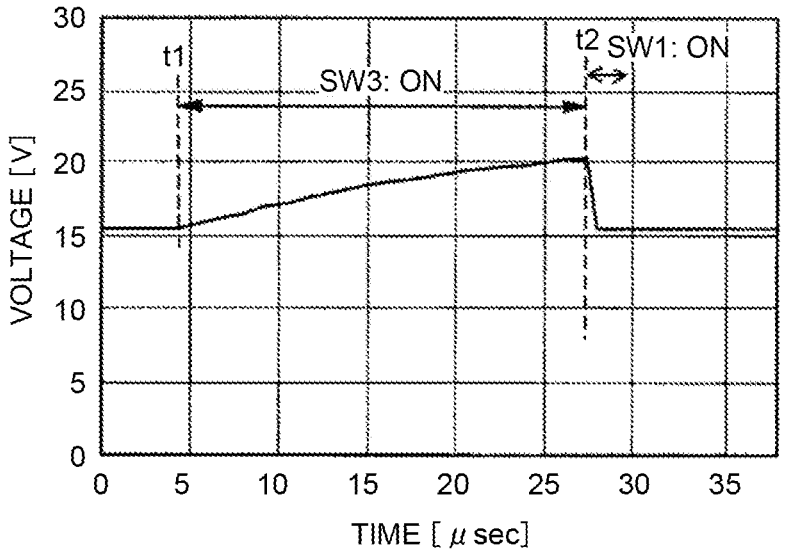
FIG. 12 is an explanatory diagram illustrating an example of changes in voltage of a piezoelectric element generating a slight vibration according to the second embodiment.

Generation of the slight vibration according to the second embodiment is described below with reference to FIG. 12. FIG. 12 is an explanatory diagram illustrating an example of changes in voltage of a piezoelectric element generating the slight vibration.

When the slight vibration is to be applied to a nozzle, the switch SW3 of the piezoelectric element 112A for the nozzle is placed in the conduction state (ON state) at t1 which is the time point immediately after the first waveform P1 of the common driving waveform Vcom is generated and output or, in the example illustrated in FIG. 12, at the time point of 4 μsec. This ON state of the switch SW3 is maintained until the time point t2 which is at the end of the fourth waveform P4. Specifically, in the example illustrated in FIG. 12, the ON state is maintained from the time point at which the common driving waveform Vcom starts until the time point of 27 μsec.

When the switch SW3 is in the ON state, the switch SW3, the power source of the high voltage Vh, and the piezoelectric element 112A form a closed circuit. Because the impedance of the power source of the high voltage Vh is low, the piezoelectric element 112A is charged from the power source of the high voltage Vh through the switch SW3. The voltage of the piezoelectric element 112A rises with a time constant that defined by the ON resistance of the switch SW3 and the capacitance of the piezoelectric element 112A. In the example illustrated in FIG. 12, the voltage rises to 20.5 V.

The switch SW3 and the switch SW1 are switched to the non-conduction state (OFF state) and the ON state, respectively, at the end of the waveform of the fourth waveform P4.

At this point, the driving-waveform generating unit 701, the switch SW1, and the piezoelectric element 112A form a closed circuit. Because the output impedance of the driving-waveform generating unit 701 is low, the voltage of the piezoelectric element 112A changes with the time constant that defined by the ON resistance of the switch SW1 and the capacitance of the piezoelectric element 112A.

Meanwhile, because the ON resistance of the switch SW1 is considerably lower than the ON resistance of the switch SW3, the voltage of the piezoelectric element 112A rises sharply from the time point t2 to the intermediate voltage Vm.

This sharp rise causes the piezoelectric element 112A to contract and a meniscus of ink to move. Thus, the slight vibration is generated.

Figure 13:
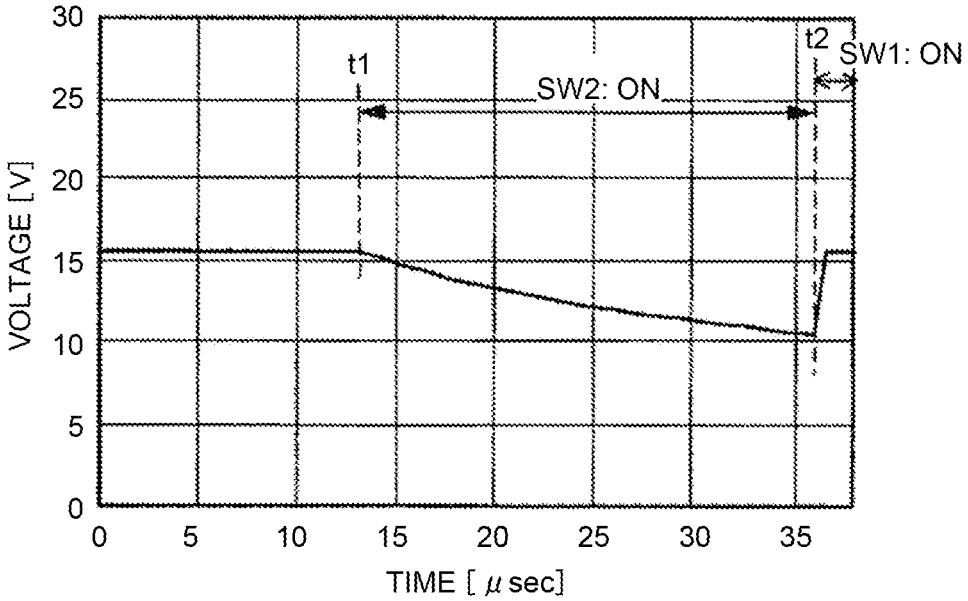
FIG. 13 is an explanatory diagram illustrating an example of changes in voltage of a piezoelectric element generating a slight vibration according to a third embodiment of the present invention.

A third embodiment of the present invention is described below with reference to FIG. 13. FIG. 13 is an explanatory diagram illustrating an example of changes in voltage of a piezoelectric element generating a slight vibration according to the third embodiment.

A circuit structure of the third embodiment is similar to that of the first embodiment. In the third embodiment, when the recording head 34 is to eject the large-size droplet, all of the first waveform P1 to the fifth waveform P5 of the common driving waveform Vcom are applied to the piezoelectric element. Accordingly, when the large-size droplet is ejected, the meniscus vibrates greatly.

A waveform component, which is a latter part, of the fifth waveform P5 is a vibration damping waveform that acts to suppress persistent vibrations after a droplet is ejected to restore the meniscus to its initial state and stabilize next drop ejection.

When the large-size droplet is ejected in a first drive period and no droplet is to be ejected or, put another way, a slight vibration is to be generated, in a second drive period immediately after the first drive period, the slight vibration is generated later than the fifth waveform P5 in the second drive period. A reason for this is to prevent lessening an effect of the slight vibration in a case where an effect of the vibration-damping waveform may be insufficient.

Specifically, as illustrated in FIG. 13, the switch SW2 is placed in the ON state immediately after the second waveform P2 ends. Immediately after the fifth waveform P5 returns to the intermediately voltage, the switch SW2 is switched from the ON state to the OFF state, and the switch SW1 is placed in the ON state.

In contrast, when the medium-size droplet or the small-size droplet is ejected in the first drive period and no droplet is to be ejected (a slight vibration is to be generated) in the second drive period immediately after the first drive period, the slight vibration is generated at timing similar to that of the first embodiment which is more advantageous against drying.

In other words, in the third embodiment, timing for state transition of the first switch device and the second switch device in the second drive period, in which the piezoelectric element generates the slight vibration, is shifted depending on the size of the droplet ejected from the nozzle in the first drive period immediately preceding the second drive period.

The third embodiment is applicable to the configuration of the second embodiment.

Figure 14:
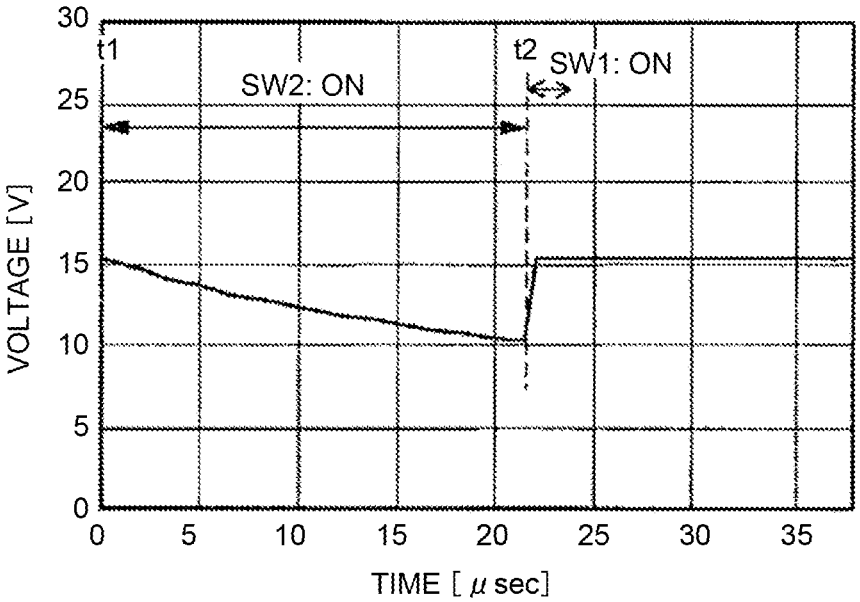
FIG. 14 is an explanatory diagram illustrating an example of changes in voltage of a piezoelectric element generating a slight vibration according to a fourth embodiment of the present invention.

A fourth embodiment of the present invention is described below with reference to FIG. 14. FIG. 14 is an explanatory diagram illustrating an example of changes in voltage of a piezoelectric element generating a slight vibration according to the fourth embodiment.

A circuit structure of the fourth embodiment is similar to that of the first embodiment. As described above, when the recording head 34 is to eject the large-size droplet, all of the first waveform P1 to the fifth waveform P5 of the common driving waveform Vcom are applied to the piezoelectric element. Accordingly, characteristics of an ejected droplet varies greatly depending on a state of the meniscus (initial meniscus) at start of ejection of the large-size droplet. This variation is undesirable from a practical application viewpoint.

For this reason, when the large-size droplet is to be ejected in a second drive period immediately after a first drive period in which a slight vibration is generated, the slight vibration is generated at relatively early timing in the first drive period.

Specifically, the slight vibration is generate as follows. As illustrated in FIG. 14, the switch SW2 is placed in the ON state immediately after the first waveform P1 starts. Immediately after the third waveform P3 returns to the intermediately voltage, the switch SW2 is switched from the ON state to the OFF state, and the switch SW1 is placed in the ON state.

In contrast, when a slight vibration is generated in the first drive period and the medium-size droplet or the small-size droplet is to be ejected in the second drive period immediately after the first drive period, the slight vibration is generated at timing similar to that of the first embodiment which is more advantageous against drying.

In other words, in the fourth embodiment, timing for state transition of the first switch device and the second switch device in the first drive period, in which the piezoelectric element generates the slight vibration, is shifted depending on the size of the droplet to be ejected from the nozzle in the second drive period immediately after the first drive period.

A configuration in which either the third embodiment or the fourth embodiment is selectively adopted depending on, for instance, characteristics of the recording head can be employed. For example, there can be employed a configuration in which the fourth embodiment is adopted when the initial meniscus state has a great influence on characteristics of large-size droplet ejection, while when higher priority is placed on the effect of damping vibrations caused by ejection of large-size droplet, the third embodiment is adopted.

According to the embodiments, slight vibrations can be generated without an increase in size of an apparatus that generates the slight vibrations.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a recording head including, at least one nozzle configured to eject droplets of liquid, and at least one corresponding piezoelectric element configured to generate pressure that causes the droplets to be ejected from the at least one nozzle;

a driving-waveform generating unit configured to generate a driving waveform to be applied to the at least one piezoelectric element of the recording head;

a first switching device between the driving-waveform generating unit and the at least one corresponding piezoelectric element;

a second switching device between a voltage and the at least one corresponding piezoelectric element; and a slight-vibration control unit configured to control the at least one corresponding piezoelectric element to generate slight vibrations that vibrate a meniscus of the liquid in the at least one nozzle to an extent at which no droplet is ejected from the at least one nozzle, wherein when the at least one nozzle is a non-ejection nozzle from which a droplet is not to be ejected, the slight-vibration control unit is configured to control the at least one corresponding piezoelectric element by, changing a voltage state of the at least one corresponding piezoelectric element by placing the second switching device in a conduction state, and when a period of time has elapsed after a switch of the second switching device to the conducting state, changing the voltage state of the at least one corresponding piezoelectric element by placing the second switching device in a non-conduction state and placing the first switching device in a conduction state, and when a droplet is ejected from the at least one nozzle in a first drive period and the at least one corresponding piezoelectric element generates the slight vibrations in a second drive period that is immediately after the first drive period, timing for state transition of the first switching device and the second switching device in the second drive period is shifted depending on a size of the droplet ejected from the at least one nozzle in the first drive period.

2. The image forming apparatus according to claim 1, wherein the voltage is ground voltage.

3. The image forming apparatus according to claim 1, wherein the voltage is higher than an intermediate voltage that is a reference voltage of the driving waveform.

4. The image forming apparatus according to claim 1, wherein a resistance of the second switching device is any one of, a first value that causes, when the at least one corresponding piezoelectric element is charged to a voltage Vm and then discharged over a time period shorter than a time period T with the second switching device in the conduction state, the at least one corresponding piezoelectric element to have a voltage equal to or less than (Vm−VB), and a second value that causes, when the at least one corresponding piezoelectric element is charged to the voltage Vm and then discharged over a time period shorter than the time period T, the at least one corresponding piezoelectric element to have a voltage equal to or greater than (Vm+Vb), wherein the Vb is a voltage necessary to cause the at least one corresponding piezoelectric element to generate the slight vibrations, the Vm is an intermediate voltage that is a reference of the driving waveform, and the time period T is a time period corresponding to a drive period.

5. An image forming apparatus comprising:

a recording head including, at least one nozzle configured to eject droplets of liquid, and at least one corresponding piezoelectric element configured to generate pressure that causes the droplets to be ejected from the at least one nozzle;

a driving-waveform generating unit configured to generate a driving waveform to be applied to the at least one piezoelectric element of the recording head;

a first switching device between the driving-waveform generating unit and the at least one corresponding piezoelectric element;

a second switching device between a voltage and the at least one corresponding piezoelectric element; and a slight-vibration control unit configured to control the at least one corresponding piezoelectric element to generate slight vibrations that vibrate a meniscus of the liquid in the at least one nozzle to an extent at which no droplet is ejected from the at least one nozzle, wherein when the at least one nozzle is a non-ejection nozzle from which a droplet is not to be ejected, the slight-vibration control unit is configured to control the at least one corresponding piezoelectric element by, changing a voltage state of the at least one corresponding piezoelectric element by placing the second switching device in a conduction state, and when a period of time has elapsed after a switch of the second switching device to the conducting state, changing the voltage state of the at least one corresponding piezoelectric element by placing the second switching device in a non-conduction state and placing the first switching device in a conduction state, and wherein when the at least one corresponding piezoelectric element generates the slight vibrations in a first drive period and a droplet is to be ejected from the at least one nozzle in a second drive period that is immediately after the first drive period, timing for state transition of the first switching device and the second switching device in the first drive period is shifted depending on a size of the droplet to be ejected from the at least one nozzle in the second drive period.

6. The image forming apparatus according to claim 5, wherein the voltage is ground voltage.

7. The image forming apparatus according to claim 5, wherein a resistance of the second switching device is any one of, a first value that causes, when the at least one corresponding piezoelectric element is charged to a voltage Vm and then discharged over a time period shorter than a time period T with the second switching device in the conduction state, the at least one corresponding piezoelectric element to have a voltage equal to or less than (Vm−VB), and a second value that causes, when the at least one corresponding piezoelectric element is charged to the voltage Vm and then discharged over a time period shorter than the time period T, the at least one corresponding piezoelectric element to have a voltage equal to or greater than (Vm+Vb), wherein the Vb is a voltage necessary to cause the at least one corresponding piezoelectric element to generate the slight vibrations, the Vm is an intermediate voltage that is a reference of the driving waveform, and the time period T is a time period corresponding to a drive period.

8. A method for controlling a recording head that includes at least one nozzle configured to eject droplets of liquid, at least one corresponding piezoelectric element, a driving-waveform generating unit, a first switching device between the driving-waveform generating unit and the at least one corresponding piezoelectric element and a second switching device between a voltage and the at least one corresponding piezoelectric element, the method comprising:

generating, in one vibration state, pressure that causes the droplets to be ejected from the at least one nozzle, and generating, in another vibration state, slight vibrations for the at least one corresponding piezoelectric element to vibrate a meniscus of the liquid of the at least one nozzle to an extent at which no droplet is ejected from the at least one nozzle;

in the other vibration state, changing a voltage state of the at least one corresponding piezoelectric element to a first voltage state by applying a voltage to the at least one corresponding piezoelectric element, and when a period of time has elapsed after a switch to the first voltage state, changing the voltage state of the at least one corresponding piezoelectric element to a second voltage state by switching off the voltage to the at least one corresponding piezoelectric element, and connecting the driving-waveform generating unit to the at least one corresponding piezoelectric element, wherein when a droplet is ejected from the at least one nozzle in a first drive period and the at least one corresponding piezoelectric element generates the slight vibrations in a second drive period that is immediately after the first drive period, timing for state transition of the first switching device and the second switching device in the second drive period is shifted depending on a size of the droplet ejected from the at least one nozzle in the first drive period.

* * * * *

UNITED STATES PATENT AND TRADEMARK OFFICE

CERTIFICATE OF CORRECTION

PATENT NO. : 8,944,560 B2
APPLICATION NO. : 13/798316
DATED : February 3, 2015
INVENTOR(S) : Sumiaki Aoki and Kohta Akiyama It is certified that error appears in the above-identified patent and that said Letters Patent is hereby corrected as shown below:

On the title page item (73), should read:

(73) Assignee: Ricoh Company, Limited, Tokyo, Japan

Signed and Sealed this
First Day of March, 2016

Michelle K. Lee

Michelle K. Lee
*Director of the United States Patent and Trademark Office*